US005253377A

United States Patent [19]

Larson

[11] Patent Number: 5,253,377

[45] Date of Patent: * Oct. 19, 1993

[54] WATERBED MATTRESS WITH BELLOWS SPRING INSERT

[76] Inventor: Lynn D. Larson, 1052 N. Lakeshore Dr., Lincoln, Nebr. 68528

[ * ] Notice: The portion of the term of this patent subsequent to Oct. 29, 2008 has been disclaimed.

[21] Appl. No.: 849,515

[22] Filed: Mar. 11, 1992

[51] Int. Cl.[5] ..... A47C 27/08; A47C 27/04; A47C 27/06; A47C 27/07

[52] U.S. Cl. ..... 5/451; 5/920; 5/476; 297/DIG. 8; 267/122

[58] Field of Search ..... 5/451, 450, 422, 919, 5/920, 921, 476; 297/DIG. 3, DIG. 8; 267/122

[56] References Cited

U.S. PATENT DOCUMENTS

| | | | |
|---|---|---|---|
| 2,897,520 | 8/1959 | Bradford | 297/DIG. 8 |
| 3,262,138 | 7/1966 | Knittel | 5/476 |
| 3,276,048 | 10/1966 | Beckman | 297/DIG. 8 |
| 3,280,410 | 10/1966 | Probst et al. | 297/DIG. 8 |
| 3,765,038 | 10/1973 | Curtis | 297/DIG. 8 |
| 4,245,363 | 1/1981 | Callaway | 5/451 |
| 5,060,328 | 10/1991 | Larson | 5/451 |

*Primary Examiner*—Alexander Grosz
*Attorney, Agent, or Firm*—John A. Beehner

[57] ABSTRACT

A waterbed mattress includes a spring insert having a plurality of open ended bellows spring units arranged in upright relation within the mattress. The pleated peripheral side wall of each bellows spring unit enables it to be collapsible from a normal expanded height to a shortened compressed height wherein the internal volume is substantially reduced. Each bellows spring unit is spring biased to its normal expanded height. The bellows spring units are snap fit into holes a spacer panel which serves to position the bellows spring units relative to one another a valve cover sheet may overlay one or both ends of the bellows spring units and have holes registered with the open ends of the bellows units to impart a hydraulic action to them in addition to their inherent spring force.

22 Claims, 4 Drawing Sheets

WATERBED MATTRESS WITH BELLOWS SPRING INSERT

BACKGROUND OF THE INVENTION

The present invention is directed generally to a waterbed mattress including a bellows spring insert for auxiliary support for loads placed on the mattress above the insert.

Improved sleep is experienced on a waterbed mattress, compared to sleep on a conventional mattress, because the support forces are more uniformly distributed across the body thereby substantially eliminating localized pressure points. This same characteristic, however, makes the top surface of a waterbed mattress more susceptible to deflection by a concentrated load such as when one sits or kneels on a waterbed mattress. Internal baffling systems and foam and fiber fillers have been incorporated into waterbed mattresses to eliminate wave action and restrict the flow therein. These, however, have only indirectly improved the resistance of a waterbed mattress surface to deflection by a concentrated load.

Previous attempts have been made to incorporate springs within a waterbed mattress. Callaway U.S. Pat. No. 4,245,363, for example, provides coil springs within an annular chamber surrounding a central waterbed mattress bladder to support one seated on the edge of a waterbed mattress. An alternate embodiment shows coil springs within the waterbed mattress bladder as well. Such a mattress, however, requires structure for supporting the individual coils and for preventing puncture of the mattress walls, all of which increase the expense of the mattress. The complexity inherently presents manufacturing problems and an increased number of potential failure points on the mattress.

Accordingly, a primary object of the invention is to provide an improved bellows spring insert for a waterbed mattress.

Another object is to provide such an insert which includes a plurality of bellows spring units having opposite open ends.

Another object is to provide such an insert which does not hold water and therefore does not resist draining of the waterbed mattress.

Another object is to provide a spring insert in which a plurality of bellows spring units are arranged and supported relative to one another.

Another object is to provide a spring insert wherein a generally flat panel has a plurality of openings for receiving and arranging respective bellows spring units.

Another object is to provide such a spring insert which does not require mechanical attachment to the waterbed mattress.

Another object is to provide such a bellows spring insert which combines mechanical spring resistance with an underlying or overlying perforated sheet to form flow resisting chambers for effecting shock absorption as well as spring resistance to concentrated loads on a waterbed mattress.

Another object is to provide such a spring insert which is free of attachment to the bottom wall of the mattress but which functions substantially as if it were so attached.

Another object is to provide an improved waterbed mattress with spring support to supplement the flotation support of a conventional waterbed mattress.

Another object is to provide an improved waterbed mattress including the spring insert of the invention.

Another object is to provide such an improved waterbed mattress and spring insert which are simple and rugged in construction, economical to manufacture and efficient in operation.

SUMMARY OF THE INVENTION

The spring insert of the present invention is adapted to be enclosed within the fluid-tight water-containing bladder of a waterbed mattress. The insert includes a plurality of bellows spring units, each having an upright pleated peripheral sidewall and opposite top and bottom open ends so as to be collapsible from a normal expanded height to a shortened compressed height wherein the internal volume of the unit is substantially reduced. Each bellows unit is spring biased to the normal expanded height thereof.

To support and space the bellows units relative to one another and in upright relation within the mattress chamber, a panel is provided with a plurality of spaced apart holes, each adapted for registration with a bellows spring unit. Because each hole is smaller than the large diameter edge of the bellows unit sidewall, a bellows unit is received in press fit relation in each hole.

The spring inserts preferably cover substantially the entire bottom surface of the mattress but may cover only selected regions most susceptible to supporting the weight of a person seated on the mattress. Furthermore, the spring bellows units are preferably arranged in uniform distribution over the mattress bottom wall but they could alternately be concentrated in particular areas if desired. A fiber layer may be installed above the spring bellows units for mechanical insulation. Other known mechanical insulators could be substituted for the fiber layer.

A valve cover sheet is wrapped around the panel and bellows spring units and is secured relative to the panel so that strategically positioned holes in the valve cover sheet are registered with the open ends of the bellows spring units. In a preferred embodiment, the holes through the top valve cover sheet are smaller than the holes through the bottom valve cover sheet. Both sheets include additional holes positioned for registration with the spaces between the bellows spring units.

Downward force exerted on a bellows unit through the mattress top wall tends to collapse the unit against the spring action of the pleated sidewall construction. That same force tends to press the valve cover sheets against the open ends of the bellows spring units so that fluid flow from each unit is generally constrained to flow through the cover sheet holes. Accordingly, each spring bellows unit functions as a shock absorber as well as a spring for firm and comfortable support even when subjected to a concentrated load.

DESCRIPTION OF THE PREFERRED EMBODIMENTS

Figure 1:
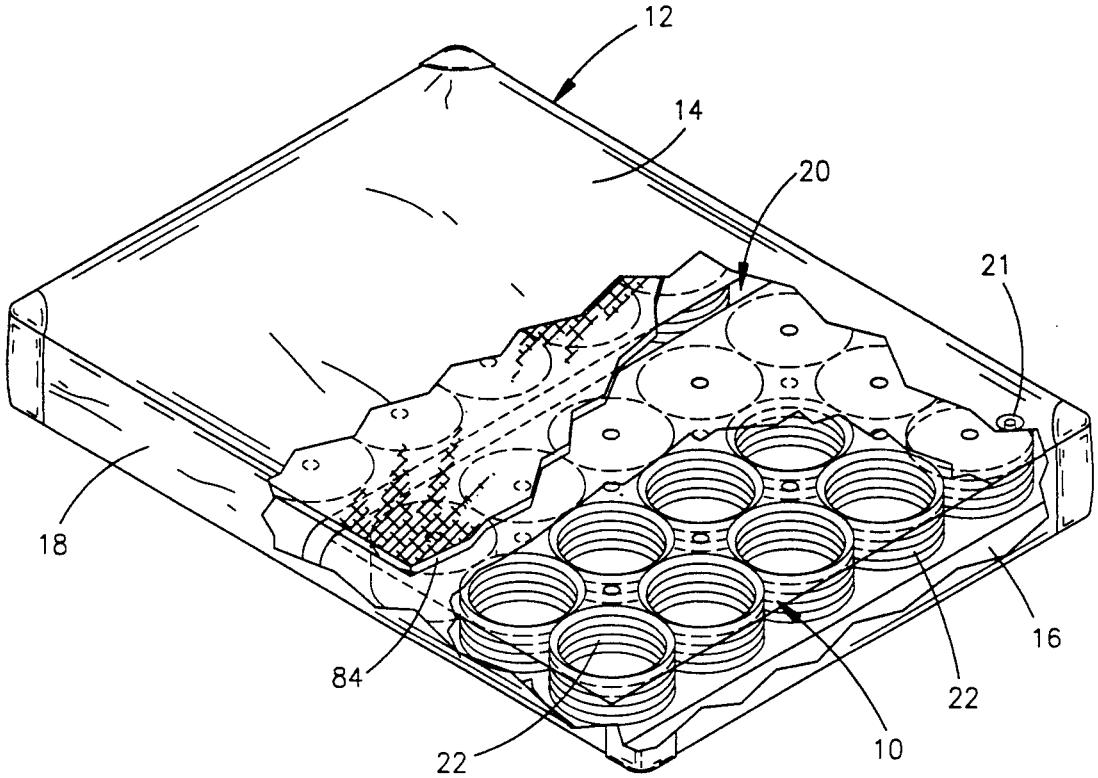
FIG. 1 is a perspective view of a waterbed mattress with portions cut away to expose the bellows spring insert therein.
Figure 2:
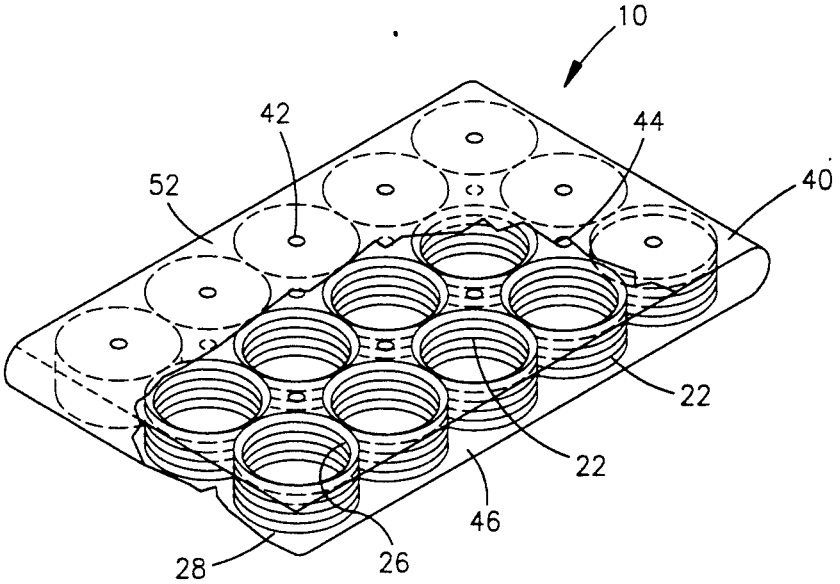
FIG. 2 is a perspective view of the bellows spring insert of the embodiment of FIG. 1.

The spring insert 10 of the present invention is illustrated in FIGS. 1 and 2 installed within a waterbed mattress 12 which includes a top wall 14, bottom wall 16 and a peripheral sidewall 18, all interconnected to define a fluid tight chamber 20.

Figure 4:
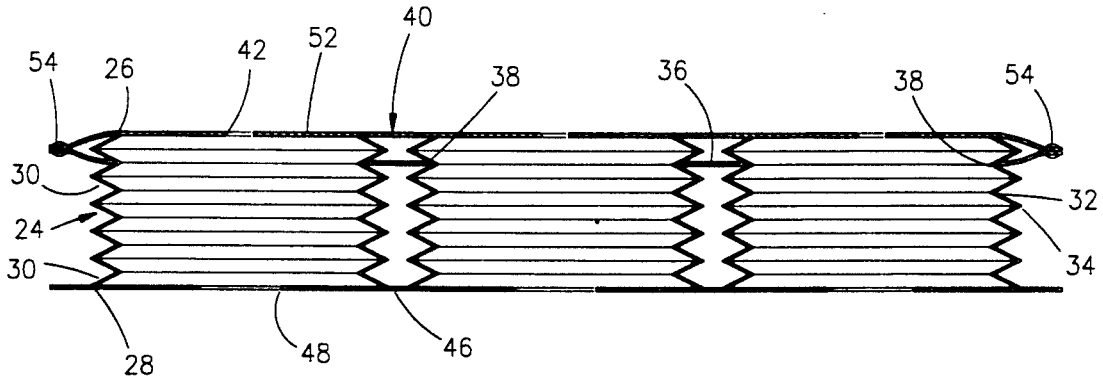
FIG. 4 is an enlarged side sectional view taken along line 4—4 in FIG. 3.
Figure 5:
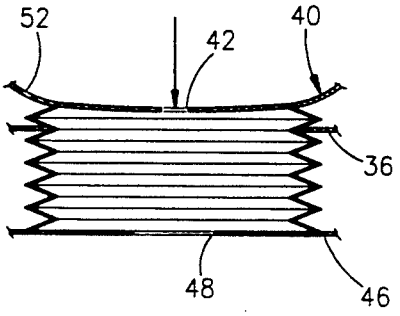
FIG. 5 is an enlarged side sectional of a bellows spring unit showing the application of downward vertical force on the cover sheet thereof.

Spring insert 10 includes a plurality of bellows spring units 22, each of which has a pleated peripheral sidewall 24 and opposite top and bottom open ends 26 and 28. The bellows are formed of a relatively stiff plastic. Whereas the pleated sidewalls afford an inherent spring action which resists compression from the normal expanded position of the bellows shown in FIG. 4, the bellows are collapsible under a load, as illustrated in FIG. 5, to a shortened compressed height Wherein the internal volume of the bellows spring unit is substantially reduced.

The pleated sidewall 24 preferably comprises a plurality of integral stacked pleats 30 which are alternately inclined so that the angles between adjacent sections may be changed to accommodate vertical expansion and compression of the overall bellows spring unit 22. The pleated wall sections are molded at angles corresponding to the normal expanded position of the bellows unit, as illustrated in FIG. 4, so that they are spring biased back to that position once compressive forces are removed from the unit.

Each pleat 30 is a frustoconical wall section having upper and lower edges, one of which is a smaller diameter edge 32 and the other a larger diameter edge 34. The bellows spring units 22 are preferably formed and oriented so that the top edge of the uppermost pleat 30 is a smaller diameter edge 32. In the first embodiment of FIGS. 1 through 5, the bottom edge of the lowermost pleat 30 is a large diameter edge 34 for stable engagement against the surface that it rests upon.

To position the bellows spring units 22 in the desired closely spaced relation relative to one another within the waterbed mattress 12 a spacer panel 36 is provided. Spacer panel 36 has a plurality of holes 38 formed therein, each hole being adapted to receive a respective bellows spring unit 22. Spacer panel 36 is shown in FIG. 4 as being snap fit over the uppermost two pleats 30 of the bellows spring units 22. This is possible because the holes in the spacer panel 36 are smaller than the larger diameter edge 34 of the adjacent pleats. The holes 38 are preferably approximately the same diameter as the smaller diameter edges 32 of the adjacent pleats. Upon snap fitting the bellow units 22 into the spacer panel holes 38, the bellows units are arranged relatively close together, but sufficiently spaced so as not to contact one another or interfere with one another upon compression of adjacent bellows spring units 22.

Figure 3:
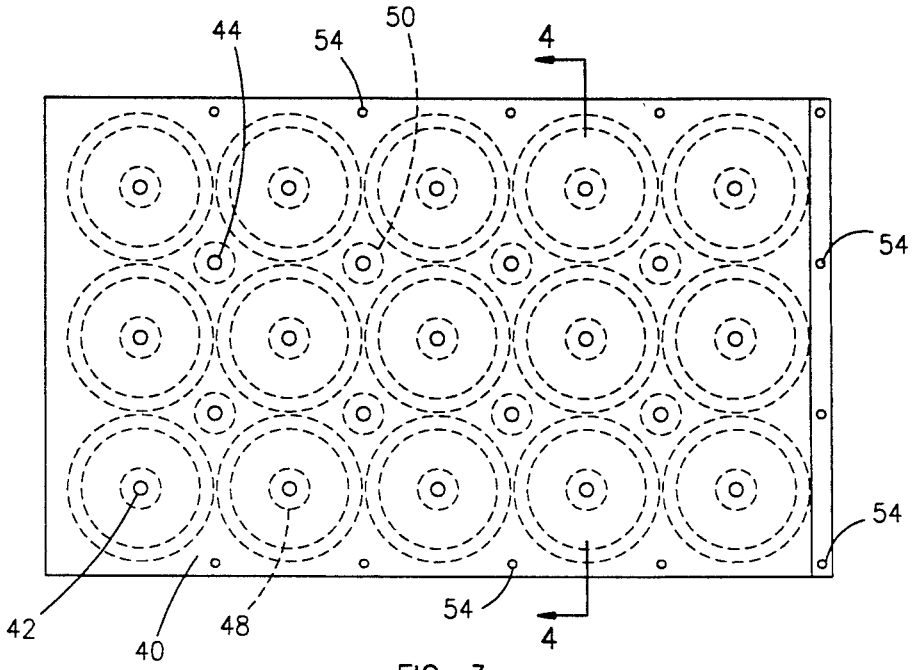
FIG. 3 is a top plan view of the bellows spring insert.

The holes 38 in the spacer panel 36 may be uniformly spaced apart in one or both directions as illustrated in FIG. 3. The holes 38 are preferably arranged substantially throughout the panel 36 so as to substantially fill the area thereof. Likewise, referring to FIG. 1, the spacer panel 36 preferably extends substantially across the mattress 12 in at least one direction. In the illustrated embodiment of FIG. 1, the spacer panel 36 provides three rows of five bellows spring units 22 extended across the width of the mattress. By arranging two spring inserts 10 in side-by-side relation within the mattress 12, the mattress bottom wall 16 is substantially covered by the bellows spring units 22 of the invention.

It is apparent that the bellows spring units could be alternately positioned relative to one another, but the illustrated arrangement is preferred both for uniformity and volume efficiency. If a single panel includes bellows spring units of different diameter, they would ideally be coordinated to have compatible spring rates.

In other embodiments, it may be desirable to vary the spring rates of the bellows spring units 22 to accommodate the varying expected pressures along the length of the mattress 12 according to the expected weight concentrations from a human body lying on the mattress. Likewise, the sizes of the bellows spring units or spring rates thereof could be altered to accommodate a heavy person on one side of the mattress and a lighter person on the opposite side of the mattress.

Coupled with the spacer panel 36 is a valve cover sheet 40 which overlies the bellows spring units 22 and which includes a plurality of the smaller holes 42, at least one hole 42 being registered with the top open end 26 of each bellows spring unit 22. Additional holes 44 are positioned for registration with the spaces between the bellows spring units 22. Loads upon the mattress top sheet press the valve cover sheet 40 against the open tops of the bellows spring units 22, thereby imparting a hydraulic shock absorber characteristic to the bellows spring units 22 in addition to their inherent spring support.

Valve cover sheet preferably wraps around the spacer panel 36 and bellows spring units 22. The bottom layer 46 of the valve cover sheet 40 has a second group of holes 48 registered with the open bottom ends 28 of the bellows spring units. Another grouping of holes 50 are registered with the spaces between bellows spring units 22, as shown best in FIG. 3. It is preferred that the holes 42 and 44 in top layer 52 are smaller than the holes 48 and 50 in the bottom layer 46 of the valve cover sheet 40.

To secure the valve cover sheet 40 relative to the spacer panel 36 and bellows spring units, opposite free-ends of the bottom layer 46 and top layer 52 are overlapped with one another and with one end of the spacer panel 36 and secured together with a series of rivets 54 as shown in FIG. 3. The long edges of the spacer panel 36 and top layer 52 are also riveted together at a plurality of locations as further illustrated in FIGS. 3 and 4.

Figure 9:
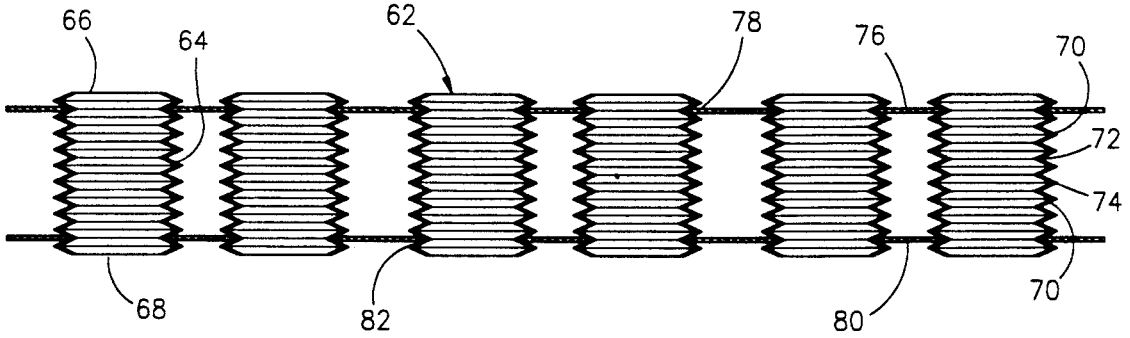
FIG. 9 is an enlarged side sectional view taken along line 9—9 in FIG. 8.

A second embodiment of the invention is illustrated in FIGS. 6 through 10 wherein spring insert 60 includes a plurality of smaller diameter bellows spring units 62, each including a pleated side wall 64 and open top and bottom ends 66 and 68. As best shown in FIG. 9, pleated side wall 64 included a plurality of stacked integral pleats 70, each having a smaller diameter edge 72 and a larger diameter edge 74. The bellows spring units 62 are furthermore configured so that the top edge of the uppermost pleat 70 and bottom edge of the lowermost pleat are both smaller diameter edges 72.

Figure 7:
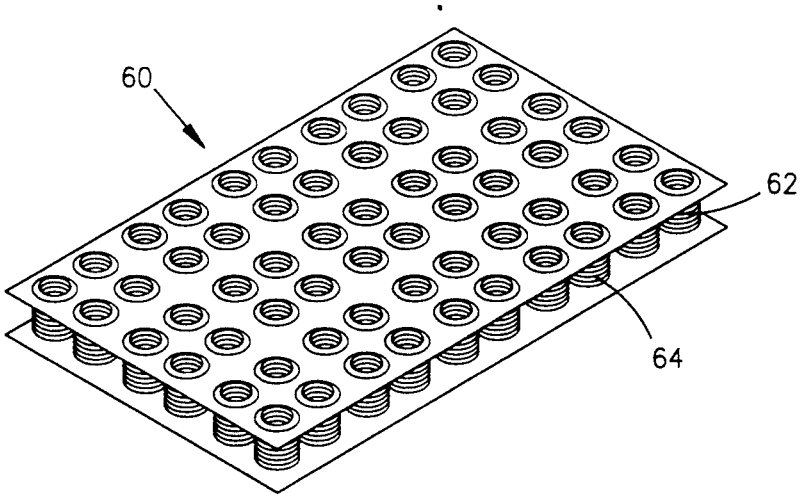
FIG. 7 is a perspective view of the bellows spring insert of the embodiment of FIG. 6.
Figure 8:
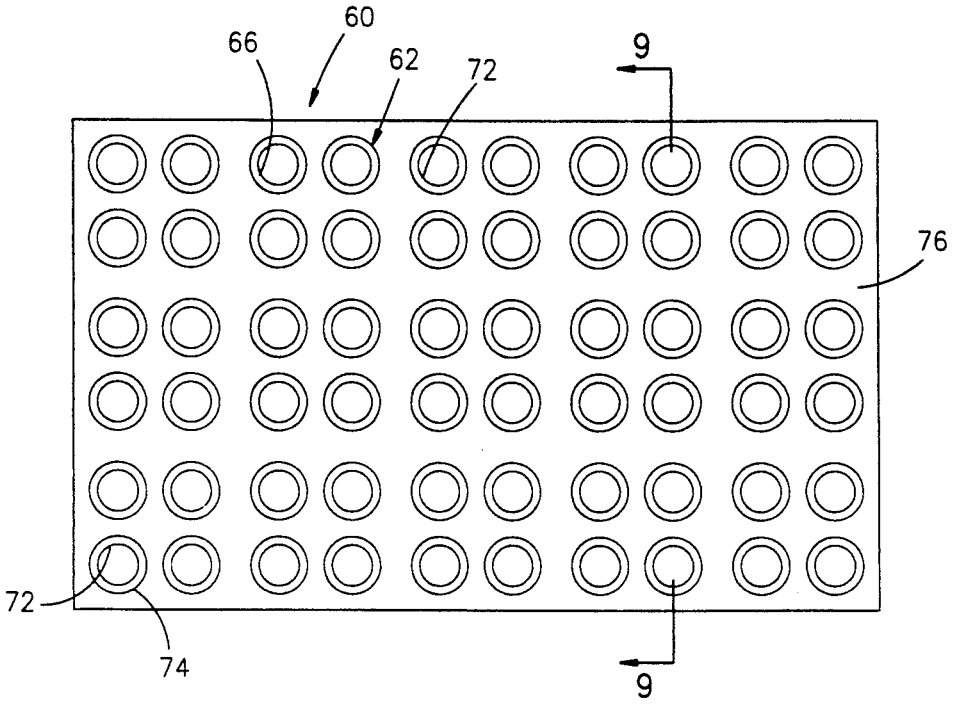
FIG. 8 is a top plan view of the bellows spring insert of the embodiment of FIG. 6.

To secure the smaller bellows spring units 62 in upright relation and in the desired positional relationship relative to one another, a top spacer panel 76 is provided with a series of holes 78, each adapted to receive a bellows spring unit 62 in snap fit relation like in the earlier embodiment. Each hole 78 is smaller than the larger diameter edge 74 of the adjacent pleats 70 and is preferably approximately the same size as the smaller diameter edge 72 for a secure hold on the individual bellows spring units 62. The top two pleats 70 are pushed through the hole 78 so that spacer panel 76 is situated adjacent the tops of the bellows spring units 62 as shown in FIG. 9. Additional stability is provided by a second spacer panel 80 having holes 82 which receive the bottom two pleats 70 of each spring unit in snap fit relation therethrough. Accordingly, a spring insert 60 includes a plurality of the bellows spring units 62 and the top and bottom spacer panels 76 and 80 as illustrated in FIG. 7.

Figure 6:
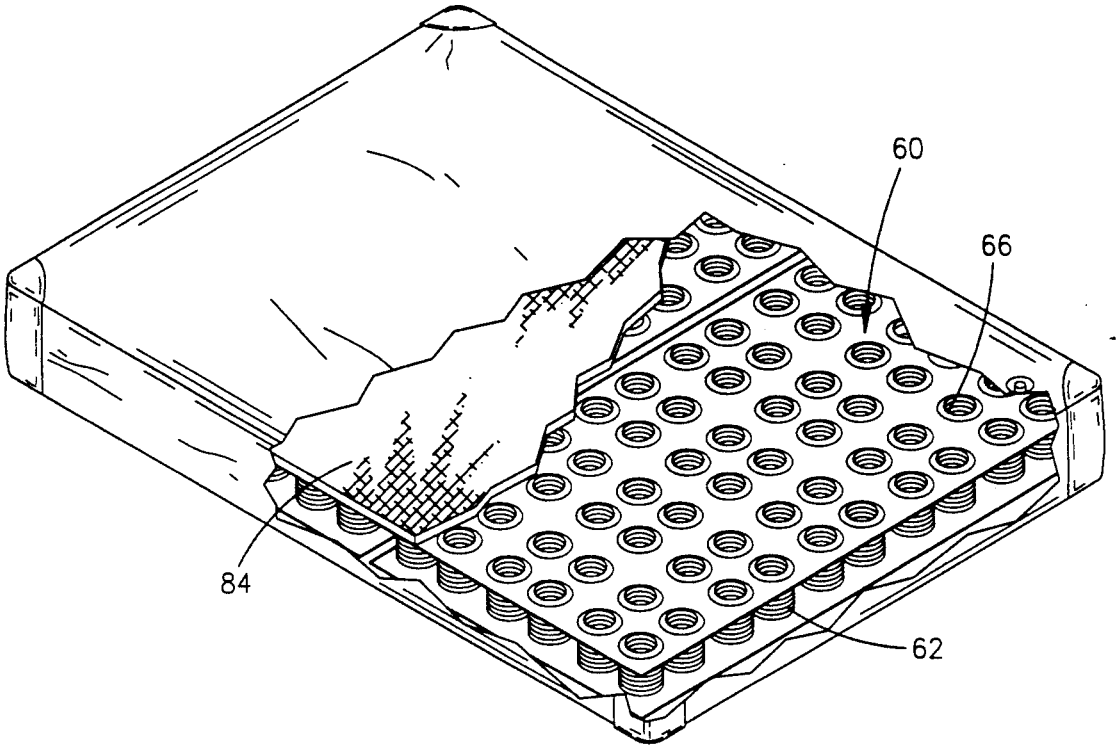
FIG. 6 is a perspective view of a second embodiment of a waterbed mattress with portions broken away to expose the bellows spring insert thereof.

In the illustrated embodiment, the size of the spring insert 60 is such that it covers approximately one half of the bottom wall 16 of a waterbed mattress 12 as illustrated in FIG. 6. Two of the spring inserts 60 laying in side-by-side relation substantially cover the entire bottom wall 16 of the mattress. The spring inserts could, of course, be otherwise shaped to cover one half of the mattress longitudinally or any selected region thereof.

An advantage of the smaller bellows spring units 62 is that a higher spring rate can be more uniformly distributed across the surface of the mattress.

It would be generally undesirable for the user of the waterbed to feel the engagement of the top wall 14 with the bellows spring units 22 or 62. For this purpose and to somewhat extend the spring action effect of the bellows spring units to the areas between the bellows units, a filler such as fiber 84 is placed on top of the spring insert 10 or 60 as illustrated in FIGS. 1 and 6 to serve as a mechanical insulator. The fiber may be polyester or any other suitable waterbed filler material. Likewise, the fiber may be replaced with other known mechanical insulators, but fiber is preferred since it does not retain water upon draining of the mattress.

Figure 10:
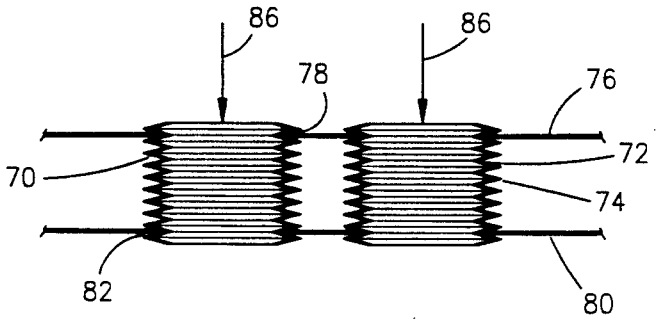
FIG. 10 is a partial enlarged side sectional view showing the application of vertical force upon the bellows spring insert of the embodiment of FIG. 6.

Since the second embodiment of FIGS. 6 through 10 does not include the wraparound valve cover sheet 40, a concentrated load, as indicated by arrows 86 in FIG. 10, sandwiches the fiber layer 84 between the mattress top wall 14 and bellows spring units 62. The load is first slightly resisted by compression of the fiber layer 84 and the forcing of fluid from the fiber above the bellows spring units 62. As the fiber is compressed against the open top ends 66 of the bellows spring units 62, the units begin to be compressed. Initial compression tends to seal the bottom edges against the mattress bottom wall 16 with the result that fluid flow from the bellows spring units 62 is substantially constrained to flow through leaks in the imperfect seal between the bellows spring units and the fiber layer 84 on top and mattress bottom wall 16 on the bottom. The inherents spring force of the pleated side wall 64 resists compression and sinking of the mattress top wall 14 further into the mattress at the point of the load 86. When coupled with the hydraulic action of the bellows spring units 62, the spring action affords a smooth cushioned resistance to even quite substantial concentrated loads, such as a person's full body weight.

Upon removal of the load 86, the spring action of the bellows spring units 62 causes them to expand back to their normal expanded height as shown in FIG. 9. The expansion generates suction forces against the mattress bottom wall 16 which tends to anchor the spring insert 60 in place within the mattress even without any mechanical fasteners.

Whereas the invention has been described in connection with preferred embodiments thereof, it is understood that many modifications, substitutions and additions may be made which are within the intended broad scope of the appended claims. For example, the bellows spring units 22 and 62 could be interconnected by structure other than the spacer panels 36 and 76. Furthermore, the pleated side walls 24 and 64 need not have the frustoconical shaped wall sections as illustrated, but rather may have a sine wave shape in cross section or any other suitable shape which produces the desired spring action. Finally, it is contemplated that the spring insert of the invention could be included as the spring element in a conventional mattress as well as in a waterbed mattress.

Thus there has shown and described an improved bellows spring insert which accomplishes at least all of the stated objects.

I claim:

1. In a waterbed mattress including a top wall, bottom wall and a peripheral sidewall, all interconnected to define a fluid tight chamber, the improvement comprising, a plurality of bellows spring units within said chamber, each unit having a generally pleated upright peripheral sidewall and opposite top and bottom open ends, each unit being collapsible from a normal expanded height to a shortened compressed height wherein the internal volume of the unit is substantially reduced, and each unit being spring biased to the normal expanded height thereof, and spacer means for supporting said bellows spring units in positional relation to one another within said chamber whereby downward force exerted on said mattress top wall tends to collapse the adjacent units against the spring action of the sidewalls thereof.

2. The waterbed mattress of claim 1 wherein said pleated peripheral sidewall comprises a plurality of integral stacked pleats, each comprising a frustoconical wall section having upper and lower edges, said edges including a smaller edge and a larger diameter edge.

3. The waterbed mattress of claim 2 wherein each bellows spring unit is oriented so that the top edge of the uppermost frustoconical wall section comprises a smaller diameter edge.

4. The waterbed mattress of claim 3 wherein each bellows spring unit has a lowermost frustoconical wall section configured so that the bottom edge comprises a larger diameter edge.

5. The waterbed mattress of claim 3 wherein each bellows spring unit has a lowermost frustoconical wall section configured so that the bottom edge comprises a smaller diameter edge.

6. In a waterbed mattress including a top wall, bottom wall and a peripheral side wall, all interconnected to define a fluid tight chamber, the improvement comprising, a plurality of bellows spring units within said chamber, each unit having a generally pleated upright peripheral sidewall and opposite top and bottom open ends, each unit being collapsible from a normal expanded height to a shortened compressed height wherein the internal volume of the unit is substantially reduced, and each unit being spring biased to the normal expanded height thereof, said pleated peripheral sidewall comprising a plurality of integral stacked pleats, each comprising a frustoconical wall section having upper and lower edges, said edges including a smaller edge and a larger diameter edge; and spacer means for supporting said bellows spring units in positional relation to one another within said chamber whereby downward force exerted on said mattress top wall tends to collapse the adjacent units against the spring action of the sidewalls thereof;

and wherein said spacer means comprising a panel having a plurality of holes therein, each hole having a respective bellows spring unit received therein and each hole being smaller than the larger diameter edge of the adjacent pleats of said respective unit.

7. The waterbed mattress of claim 6 wherein said holes in the panel are uniformly spaced apart in at least one direction.

8. The waterbed mattress of claim 6 wherein said holes are arranged substantially throughout the surface of said panel.

9. The waterbed mattress of claim 8 wherein said panel extends substantially across said mattress in at least one direction.

10. The waterbed mattress of claim 9 further comprising a plurality of panels and associated bellows spring units arranged in side by side relation within said mattress.

11. The waterbed mattress of comprising a valve cover sheet covering at least one end of the bellows spring units received in said panel, said valve cover sheet including a plurality of holes, at least one hole adapted for registration with an open end of each bellows spring unit.

12. The waterbed mattress of claim 11 further comprising securement means for positioning said valve cover sheet relative to said panel to maintain registration of said holes with the open ends of the bellows spring units.

13. The waterbed mattress of claim 12 wherein said valve cover sheet further comprises a plurality of holes arranged for registration with the spaces between said bellows spring units.

14. The waterbed mattress of claim 13 wherein said valve cover sheet wraps around said panel so as to cover both open ends of the bellows spring units, said valve cover sheet having a second plurality of holes in registration with the opposite open ends of said bellows spring units.

15. The waterbed mattress of claim 14 wherein said first plurality of holes are smaller than said second plurality of holes, said first plurality of holes being adapted for registration with the open top edges of said bellows spring units.

16. The waterbed mattress of claim 15 wherein said valve cover sheet has opposite ends which are secured both together and to said panel.

17. The waterbed mattress of claim 16 wherein said securement means comprises a plurality of rivets.

18. The waterbed mattress of claim 6 wherein said spacer means further comprises a second panel having a plurality of holes therein, each hole having an opposite end of a respective bellows spring unit received therein and each hole being smaller than the larger diameter edge of the adjacent pleats of said respective unit.

19. The waterbed mattress of claim 18 wherein said panels are connected to said bellows spring units at positions such that two pleats are arranged externally of each panel with all remaining pleats arranged between the panels.

20. The waterbed mattress of said panel is free of any mechanical attachment to the mattress.

21. The waterbed mattress of claim 20 further comprising a mechanical insulator overlying said bellows spring units.

22. In a waterbed mattress including a top wall, bottom wall and a peripheral side wall, all interconnected to define a fluid tight mattress chamber, the improvement comprising, a plurality of bellows spring units within said chamber, each unit having a generally pleated upright peripheral side wall and opposite top and bottom open ends, each unit being collapsible from a normal expanded height to a shortened compressed height wherein the internal volume of the unit is substantially reduced, and each unit being spring biased to the normal expanded height thereof, spacer means for supporting said bellows spring units in positional relation to one another within said chamber, and a mechanical insulator layer overlying said bellows spring units whereby downward force exerted on said mattress top wall is transmitted through said mechanical insulator layer to collapse the adjacent bellows spring units against the spring action of the side walls thereof, said spacer means comprising a panel having a plurality of holes therein, each hole having a respective bellows spring unit received therein and each hole being smaller than the larger diameter edge of the adjacent pleats of said respective unit.

* * * * *